United States Patent [19]

Dickson

[11] 4,446,985

[45] May 8, 1984

[54] CLOSURE FOR CONTAINERS

[76] Inventor: Kenneth A. Dickson, 14 Chipping Rd., City Beach, Western Australia, Australia

[21] Appl. No.: 456,053

[22] PCT Filed: May 11, 1982

[86] PCT No.: PCT/AU82/00074

§ 371 Date: Jan. 4, 1983

§ 102(e) Date: Jan. 4, 1983

[87] PCT Pub. No.: WO82/04026

PCT Pub. Date: Nov. 25, 1982

[30] Foreign Application Priority Data

May 11, 1981 [AU] Australia ..... PE8795

[51] Int. Cl.[3] ..... B65D 41/32

[52] U.S. Cl. ..... 220/269

[58] Field of Search ..... 220/269–273

[56] References Cited

U.S. PATENT DOCUMENTS 3,795,342 3/1974 Ashton ..... 220/269

3,877,606 4/1975 Silver ..... 220/269

4,084,721 4/1978 Perry ..... 220/269

*Primary Examiner*—George T. Hall

*Attorney, Agent, or Firm*—Harness, Dickey & Pierce

[57] ABSTRACT

A closure for containers of the easy opening type. The closure consists of a wall (13) for one end of the container (11). The wall (13) has an upstanding peripheral flange (19). A continuous score line (21) in the wall (13) defines a tear portion (23) which is only partially removable from the wall (13). The score line (21) is interrupted to form an unscored section (31). A tab (35) is attached to the tear portion (23) for rupturing the score line (21) and enabling separation of the tear portion (23) from the wall (13) along the score line (21). Upon separation of the tear portion (23) from the wall (13) along the score line (21), the tear portion (23) remains attached to the wall (13) at the unscored section (31) and may be folded into a position in which it lies in the confines of the wall (13) and in the space defined between the wall and the outer edge of the upstanding flange (19).

19 Claims, 10 Drawing Figures

CLOSURE FOR CONTAINERS

This invention relates to a closure for containers and in particular to a closure for containers of the easy-opening type.

Easy-opening containers, such as metal cans, of the general type to which the invention relates are primarily intended for the packaging of beverages. One known type of closure for such containers comprises a tear portion formed in an end wall of the container, the tear portion being defined by a score line. A pull tab is attached to the tear portion and is arranged such that upon lifting the pull tab, rupture of the score line is initiated and thereafter upon pulling of the pull tab complete severance of the tear portion from the container is effected. Upon separation of the tear portion from the container, a dispensing opening is defined in the end wall through which dispensing opening the contents of the container may be poured or otherwise dispensed.

While this known type of closure is effective in operation, it does have a disadvantage in that the tear portion is completely separated from the container and is often disgarded in public places, thereby creating a litter problem. Various proposals have been presented to overcome this problem, and typically these proposals rely on the tear portion remaining attached to the container, so that it cannot be disgarded separately. A common arrangement of this type is that in which the tear portion is defined by a score line which extends around the major portion of the tear strip, but which is interupted at a point to leave an unscored section which prevents complete detachment of the tear portion from the container. By means of direct finger pressure or a lift tab, downward pressure may be applied to the tear portion to rupture the score line and hinge the tear portion downwardly into the container, where it remains attached to the container by the unscored section. While this arrangement prevents complete detachment of the tear portion from the container, it has not proved altogether satisfactory and has not been fully accepted by the public and health authorities because of the potential of contamination of the beverage by the tear portion when the tear portion is in the container.

A further arrangement which has been proposed consists of tear portion which upon severance of the score line remains attached to the container, but rather than being hinged downward into the container is folded back away from the discharge opening into a position in which it extends beyond the periphery of the can. This arrangement is not satisfactory in that when an open can is disgarded, sharp edges of the tear portion remain exposed and thus present a danger, especially to persons in bare feet.

It is an object of this invention to overcome or at least lessen the above mentioned disadvantages by providing a closure for a container in which the tear portion remains attached to the container and may be folded into a position in which it lies clear of the discharge opening and within the confines of the container without entering the interior of the container.

In one form the invention resides in a closure for a container comprising; a wall for one end of the container, the wall have an upstanding peripheral flange, a continuous scoreline in the wall defining a tear portion only partially removable from the wall, the tear portion occupying first, second and third zones in the wall, the first zone being centrally located in the wall, the second being adjacent the edge of wall and the third zone being displaced from both the first and second zones and also from the edge of the wall, the score line encompassing the first, second and third zones and being interrupted to form an unscored section at the third zone, means for rupturing the score line at the first zone and enabling separation of the tear portion from the wall along the score lines, the tear portion when removed from the wall along the scoreline being attached to the wall by the unscored section and being able to be folded into a position in which it lies in the confines of the wall and in the space defined between the wall and the outer edge of the upstanding flange.

The invention will be better understood by reference to the following description of one specific embodiment thereof. The description will be made with reference to the accompanying drawings in which.

Figure 3:
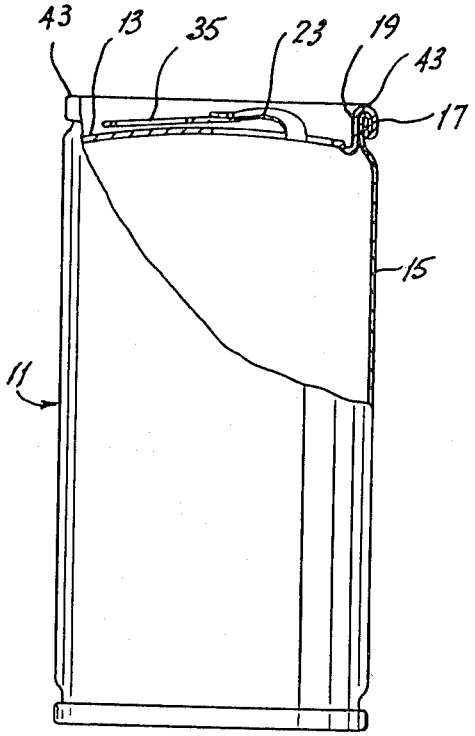
FIG. 3 is a partial sectional elevation of the container of FIG. 1, illustrating the closure in the open position.
Figure 1:
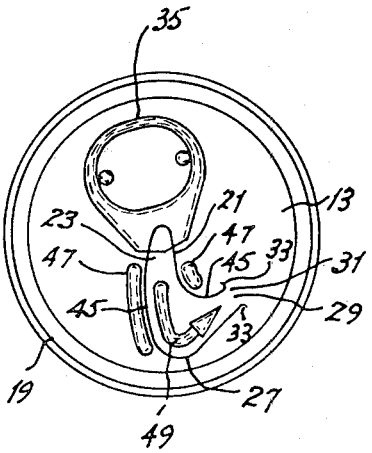
FIG. 1 is a plan view of a container with a closure according to the embodiment, illustrating the closure in the closed position.

The embodiment shown in the drawings is directed to a closure for a metal can of the type used for the packaging of beverages. The can 11 has at one end a wall 13 which is fastened to the side wall 15 of the can by means of a rolled joint 17. Because of the nature of the rolled joint 17, the end wall 13 has an upstanding peripheral flange 19.

A continuous scoreline 21 in the end wall 13 defines a tear portion 23 which is only partially removable from the wall. The tear portion 21 occupies a first zone 25 which is centrally located in the wall, a second zone 27 which is adjacent the edge of the wall and a third zone 29 which is displaced from both the first and second zones and also from the edge of the wall. The scoreline 21 encompasses the first, second and third zone and is interrupted to form an unscored section 31 at the third zone. At the interruption, the scoreline 21 is formed with a pair of outwardly extending curves 33. A tab 35 is attached to the tear portion at the first by means of a rivet 37 which is formed integral with the tear portion. The tab 35 is of conventional construction and has a peel 38 which is adapted to bear on the tear portion when the tab is lifted in the conventional manner.

Figure 2:
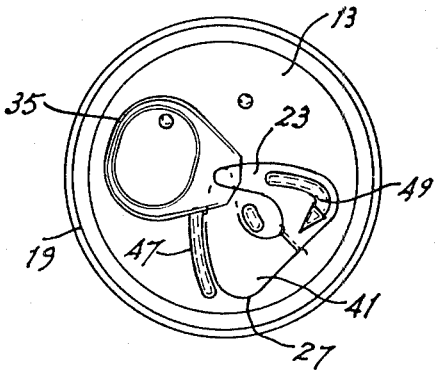
FIG. 2 is a plan view of the container shown in FIG. 1, illustrating the closure in the open position.
Figure 4:
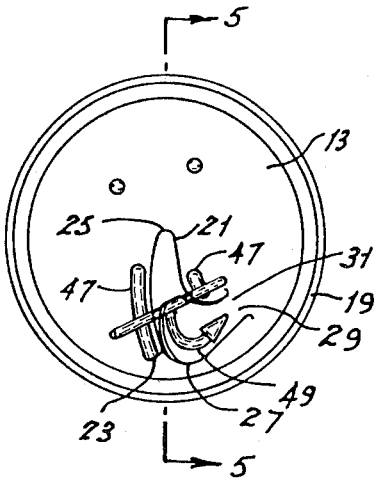
FIG. 4 is a plan view of the container, illustrating the disposition of a tear portion after rupture of the scoreline and commencement of severence thereof.
Figure 5:
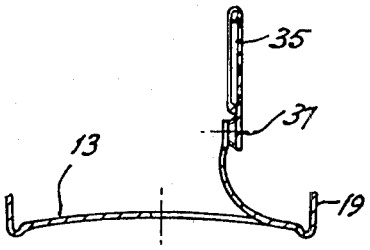
FIG. 5 is sectional view of the container end, as seen along the lines 5—5 of FIG. 4.
Figure 6:
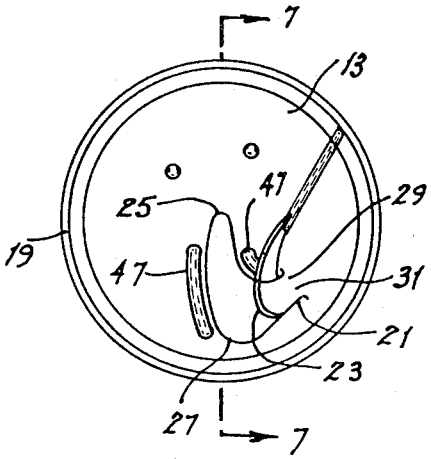
FIG. 6 is a view similar to FIG. 4, illustrating the disposition of the tear portion at a later stage of severance of the score line.
Figure 7:
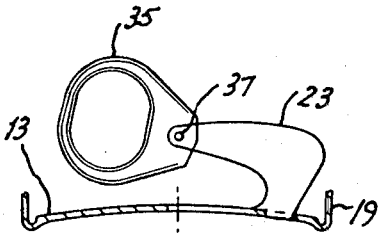
FIG. 7 is a sectional view of the can end, as seen along line 7—7 in FIG. 6.
Figure 10:
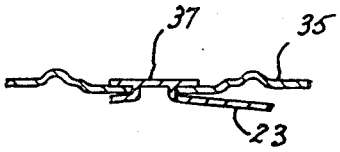
FIG. 10 is a fragmentary sectional view of the can end on an enlarged scale, illustrating attachment of the left tab to the rear portion.
Figure 9:
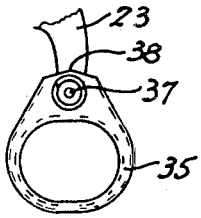
FIG. 9 is a fragmentary plan view illustrating the tear portion and the lift tab.
Figure 8:
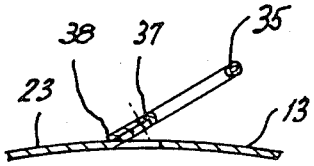
FIG. 8 is a partial sectional view of the can top illustrating the position of the lift tab at which it effects rupturing of the score line.

When a user lifts the tab, the score line 21 is ruptured at the first zone (as shown in FIG. 8), so that by pulling on the tab the tear portion may be severed from the wall along the score line to define a discharge opening 41 the major portion of which is located at the second zone 27. The tear portion 23 remains attached to the end wall 13 at the unscored section 31, the outwardly directed curves 33 preventing continuance of the severing action beyond the sore line. The tear portion 23 is then able to be folded into position (as shown in FIGS. 2 and 3) of which it is clear of the discharge opening 41 and in which the tear portion and the tab 35 lie within the confines of the end wall 13 and in the space defined between the wall and the outer edge 43 of the upstanding flange 19. In this way, when the can is opened the tear portion remains attached to the can, and the tear portion and tab may be folded into a position in which they lie within the confines lines of the can, thereby ensuring that the sharp edges of the tear portion are not exposed.

In the illustrated arrangement, the score line 21 comprises a pair of arcuate score line portions 45 which are merged at the first zone 25 and which terminate at the third zone 29 at the respective curves 33. With this arrangement, separation of the tear portion from the end wall along the score line progresses smoothly from the first zone through the second zone to the third zone.

In the end wall 13 there is provided strengthing rib 47 adjacent each score line portion 45 on the side thereof remote from the tear portion 23. In the illustrated arrangement, the strengthing rib 47 comprises raised formations in the end wall 13. In addition, in the tear portion 23 there is formed a strengthing rib 49 the purpose of which is to resist curling of the tear portion as it is separated from the end wall along the score line. If the tear portion curls as it is separated from the end wall along the score line, it may be necessary to at least partially remove the curl before the tear portion can be folded into a position in which it lies within the confines of the can. The rib 49 comprises a raised formation in the tear portion 23 and is in the form of an arrow which serves as a directional device to indicate to a user a direction in which the tear portion moves as it is separated from the wall along the score line.

From the foregoing, it is evident that the present invention provides a closure for a container in which the tear portion remains attached to the container when the latter is opened and in which the tear portion may be folded into a position in which it lies within the confines of the container so that if the can is disgarded, the sharp edges of the tear portion are not exposed so as not to be liable to cause injury.

It should be appreciated that the scope of the invention is not limited to the scope of the embodiment described and that various alterations and modifications may be made without departing from the scope of invention.

I claim:

1. A closure for a container comprising: a wall for one end of a container, the wall having an upstanding peripheral flange, a continuous scoreline in the wall defining a tear portion only partially removable from the wall, the tear portion occupying first, second and third zones in the wall, the first zone being centrally located in the wall, the second zone being adjacent the edge of the wall and the third zone being displaced from both the first and second zones and also from the edge of the wall, the score line encompassing the first, second and third zones and being interupted to form an unscored section at the third zone, means for rupturing the score line at the first zone and enabling separation of the tear portion from the wall along the score line, the tear portion when removed from the wall along the score line being attached to the wall by the unscored section and being able to be folded into a position in which it lies within the confines of the wall and in the space defined between the wall and the outer edge of the upstanding flange.

2. The closure as claimed in claim 1 wherein said means for rupturing the score line and enabling separation of the tear portion along the score line comprises a tab attached to the tear portion at the first zone.

3. A closure as claimed in claim 1 wherein the score line comprises a pair of arcuate score line portions joined at the ends thereof remote from said interruption.

4. A closure as claimed in claim 1 wherein an outwardly extending curve is formed at each end of the score line at said interruption.

5. A closure as claimed in claim 1 wherein a strengthening rib is formed in the tear portion to resist curling of the tear portion as it is separated from the wall along the score line.

6. A closure as claimed in claim 5 wherein the strengthening rib is arcuate in shape and extends from a region adjacent said first zone to a region adjacent said second zone.

7. A closure as claimed in claim 5 wherein the strengthening rib is in the form of a directional indicator.

8. A closure as claimed in claim 3 wherein a strengthening rib is formed in the end wall adjacent each arcuate score line portion on the side thereof remote from the tear strip.

9. A closure as claimed in claim 2 wherein the score line comprises a pair of arcuate score line portions joined at the ends thereof remote from said interruption.

10. A closure as claimed in claim 2 wherein an outwardly extending curve is formed at each end of the score line at said interruption.

11. A closure as claim in claim 3 wherein an outwardly extending curve is formed at each end of the score line at said interruption.

12. A closure as claimed in claim 2 wherein a strengthening rib is formed in the tear portion to resist curling of the tear portion as it is separated from the wall along the score line.

13. A closure as claimed in claim 3 wherein a strengthening rib is formed in the tear portion to resist curling of the tear portion as it is separated from the wall along the score line.

14. A closure as claimed in claim 4 wherein a strengthening rib is formed in the tear portion to resist curling of the tear portion as it is separated from the wall along the score line.

15. A closure as claimed in claim 12 wherein the strengthening rib is arcuate in shape and extends from a region adjacent said first zone to a region adjacent said second zone.

16. A closure as claimed in claim 13 wherein the strengthening rib is arcuate in shape and extends from a region adjacent said first zone to a region adjacent said second zone.

17. A closure as claimed in claim 14 wherein the strenthening rib is arcuate in shape and extends from a region adjacent said first zone to a region adjacent said second zone.

18. A closure as claimed in claim 11 wherein a strengthening rib is formed in the end wall adjacent each arcuate score line portion on the side thereof remote from the tear strip.

19. A closure as claimed in claim 13 wherein a strengthening rib is formed in the end wall adjacent each arcuate score line portion on the side thereof remote from the tear strip.

* * * * *